US005348306A

United States Patent [19]

Strishak et al.

[11] Patent Number: 5,348,306

[45] Date of Patent: Sep. 20, 1994

[54] GAME APPARATUS AND METHOD FOR PLAYING SAME

[76] Inventors: Anatole Strishak, 124 Whistler Rd., Manhasset, N.Y. 11030; Andre Strishak, 201 E. 87th St., Apt. 30F, New York, N.Y. 10128

[21] Appl. No.: 109,629

[22] Filed: Aug. 20, 1993

[51] Int. Cl.[5] ..... A63B 67/00

[52] U.S. Cl. ..... 273/317

[58] Field of Search ..... 273/317, 341, 348, 407, 273/411, 378, 386, 393

[56] References Cited

U.S. PATENT DOCUMENTS 2,520,392 8/1950 Flenghi ..... 273/393
3,024,024 3/1962 Chalcroft ..... 273/411
3,792,864 2/1974 Kelly ..... 273/407 X

*Primary Examiner*—William H. Grieb
*Attorney, Agent, or Firm*—Collard & Roe

[57] ABSTRACT

A game apparatus for play by two opposing teams having a playing surface including two target receiving regions located a spaced distance apart from each other. Each region corresponds to one team. Each target receiving region includes a set of target members which are arranged in a predetermined configuration within the respective target receiving region. Each team has a set of tossing devices. The teams alternately throw the tossing devices at the opposing team's target members to knock them out of their respective target receiving regions, in advance of the opposing team to win the game.

11 Claims, 3 Drawing Sheets

GAME APPARATUS AND METHOD FOR PLAYING SAME

BACKGROUND OF THE INVENTION

1. Field of the Invention

The present invention relates to a game apparatus and method for playing the game. More particularly, it relates to a game where sticks are thrown from a certain distance to knock stones out of a delineated region.

2. The Prior Art

Many games are known which test the throwing accuracy of the players. However, there are no games in which the game court can be simply drawn in chalk on a flat surface. Furthermore, there are no games in which the apparatus consists of several sets of sticks and stones or other items that can be easily collected by the players. In addition, it would be desirable to have such a game in which the length of the game can be altered by choosing a selected number of configurations that constitute rounds of the game.

SUMMARY OF THE INVENTION

It is therefore an object of the present invention to overcome the drawbacks of the prior art and to provide a game apparatus and method for playing same where the players compete with their individual throwing abilities.

It is a further object of the present invention to provide a game apparatus and method for playing same where the game court can be simply drawn on a flat surface.

It is still another object of the present invention to provide a game apparatus and method for playing same in which the object of the game is to knock stones out of a delineated region by throwing objects from a predetermined distance away.

It is still another object of the present invention to provide a game apparatus and method for playing same wherein the length of play is determined by choosing a selected number of stone configurations which determine the rounds of the game.

These and other related objects are achieved according to the invention by a game apparatus for play by two opposing teams having a playing surface including two target receiving regions located a spaced distance apart from each other. Each region corresponds to one team. The game apparatus further includes two sets of target members with each set of target members corresponding to one of the two target receiving regions. Each set of target members is arranged in a predetermined configuration within its respective target receiving region. The game apparatus has a set of tossing devices, wherein the teams alternate throwing the tossing devices at the opposing team's target members to knock them out of their respective target receiving regions in advance of their opponents.

The playing surface or game court includes a midline and one or two baselines behind which the tossing devices are thrown from. The midline is located equidistantly between the baseline and the target receiving region.

The method for playing a game with opposing team according to the invention comprises the steps of delineating two spaced apart target receiving regions on a playing surface and arranging a set of target members in a predetermined configuration within each target receiving region. One target receiving region and the respective set of target members is assigned to each team. Tossing devices are thrown at the opposing team's target members to knock the target members out of the target receiving region in advance of the opposing team. Once all of the target members are knocked out of the target receiving region, the target members are subsequently arranged in a further predetermined configuration. The target members are all knocked out of the target receiving region and arranged in a further predetermined configuration until all of the predetermined configurations have been knocked out of the target receiving region.

BRIEF DESCRIPTION OF THE DRAWINGS

Other objects and features of the present invention will become apparent from the following detailed description considered in connection with the accompanying drawings which disclose several embodiments of the present invention. It should be understood, however, that the drawings are designed for the purpose of illustration only and not as a definition of the limits of the invention.

In the drawings, wherein similar reference characters denote similar elements throughout the several views.

DETAILED DESCRIPTION OF PREFERRED EMBODIMENTS

Referring now in detail to the drawings and, in particular, to FIGS. 1–15, there is shown multiple configurations for stones 20. Each configuration includes five cylindrical stones, for example. It should be understood, however, that any number or shapes of stones may be used and that the configurations shown in FIGS. 1–15 are merely exemplary and that many other configurations are suitable for use with the game according to the invention.

Figure 16:
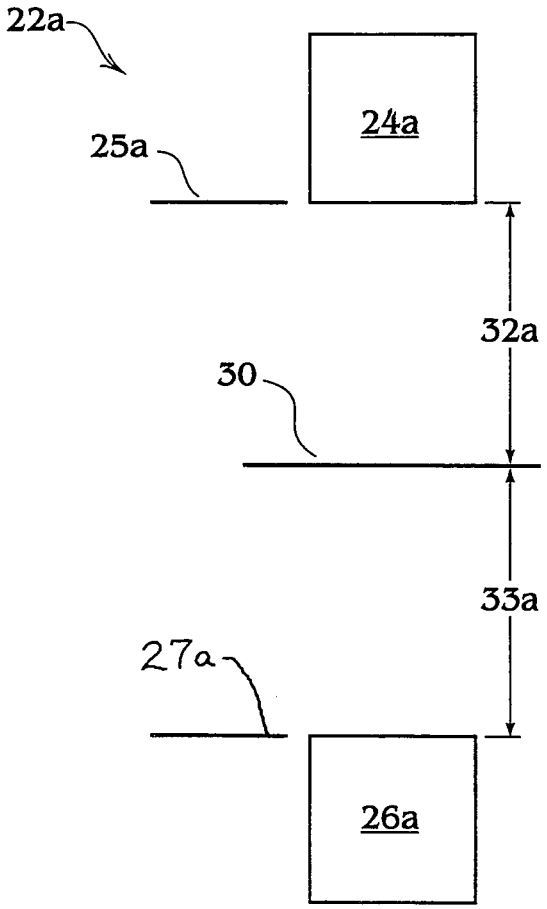
FIG. 16 is a top plan view of a first embodiment of the playing court.

FIG. 16 shows a first embodiment of a playing court **22*a* having delineated regions or squares 24*a* and 26*a*. The delineated regions 24*a* and 26*a* are shown as being 5' by 5' square, although other shapes and sizes may also be employed. Adjacent each delineated region 24*a* and 26*a* is a baseline 25*a* and 27*a*. Midway between regions 24*a* and 26*a* and baseline 25*a* and 27*a* is a midline 30. A distance 32*a* between baseline 25*a* and midline 30 is 12', for example. A distance 33*a* between baseline 27*a* and midline 30 is also 12'** for example.

Figure 17:
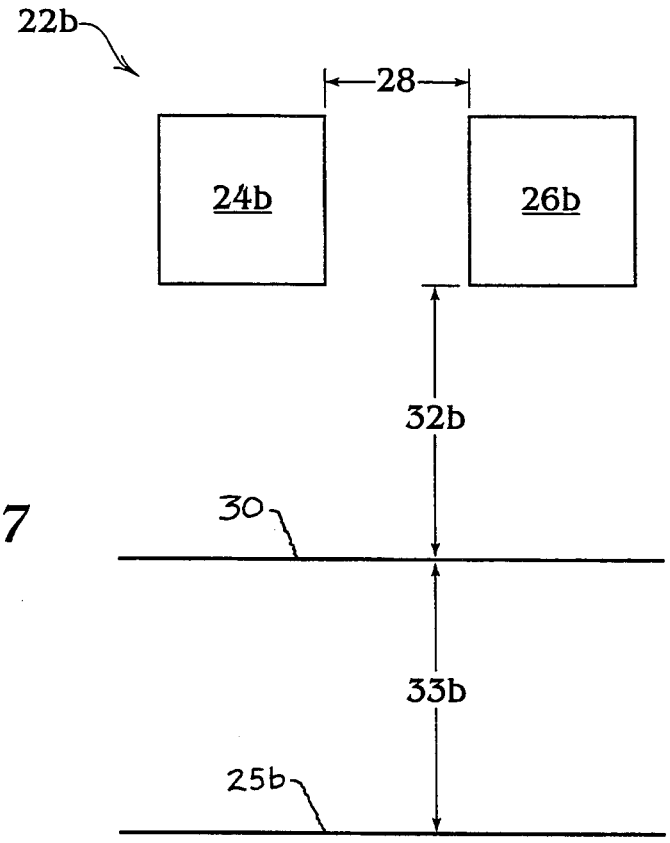
FIG. 17 is a top plan view of a second embodiment of the playing court.

FIG. 17 shows an alternate embodiment of a playing court **22*b* having delineated regions or squares 24*b* and 26*b*. Regions 24*b* and 26*b* are 5' by 5' squares or any other size or shape. A distance 28 between regions 24*b* and 26*b* is 5' or equal to one of the sides of squares 24*b* and 26*b*. Midline 30 is located 12' from regions 24*b* and 26*b*. Baseline 25*b* is located 12' from midline 30**, for example.

Before playing the game, the playing court must be laid out, for example, by writing with chalk on concrete or asphalt. In essence, the playing court requires two closed regions, a midline placed a certain distance away from the regions, and a baseline located a further distance away from the regions. FIGS. 16 and 17 show two embodiments of a playing court 22, although many other playing courts can be designed for playing the game. Extra room should be left behind each region 24 an 26 for the sticks and stones to land.

Figure 1:
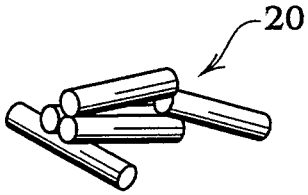
FIGS. 1–15 are perspective views showing selected configurations for the target members on the playing court.
Figure 2:
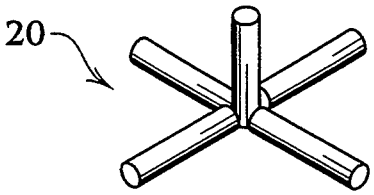
Figure 3:
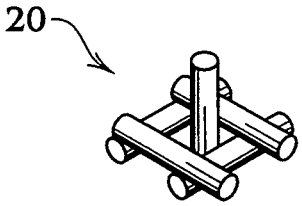
Figure 4:
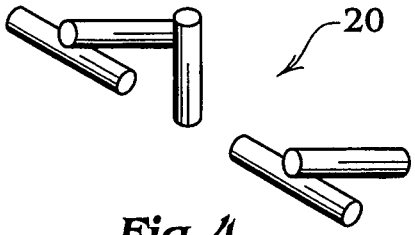
Figure 5:
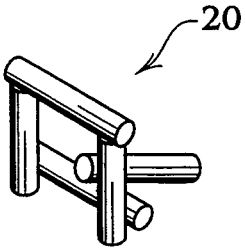
Figure 6:
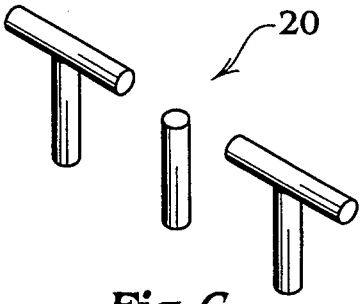
Figure 7:
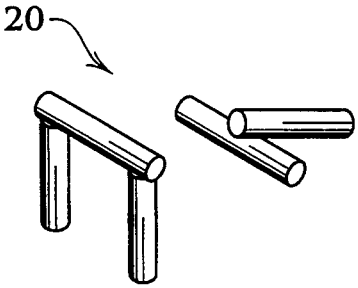
Figure 8:
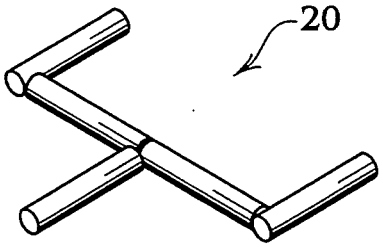
Figure 9:
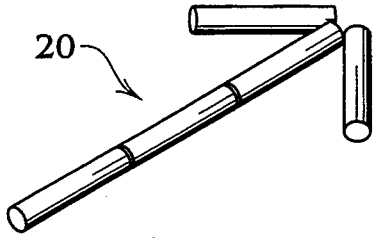
Figure 10:
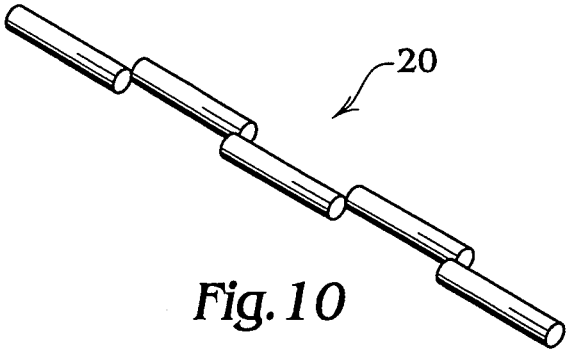
Figure 11:
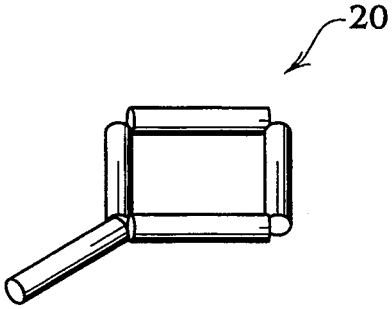
Figure 12:
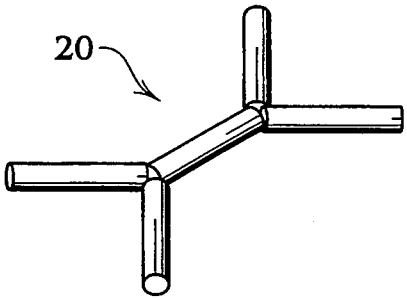
Figure 13:
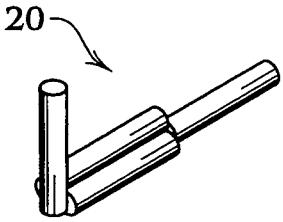
Figure 14:
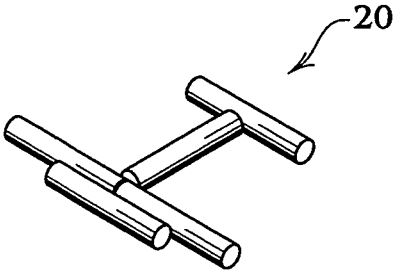
Figure 15:
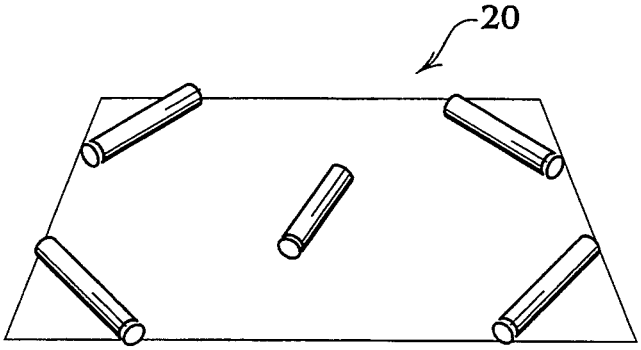
Figure 18:
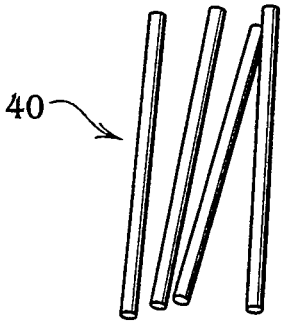
FIG. 18 is a top plan view of the sticks.

The players are then divided into two teams of an approximately equal number of players. For example, each team may include one player or two players. One or more configurations are selected from FIGS. 1–15 or from other configurations created by the players. Assume that the configurations shown in FIGS. 5 and 10 have been selected, whereby the game will consist of two rounds. Each team places one set of stones within their delineated region, in the configuration of FIG. 5. The first team then is provided with four tossing devices or sticks 40 (as can be seen in FIG. 18) to be thrown at the opposing team's stones 20 within the delineated region. The first designated player stands behind baseline 25*a* and throws four sticks 40 at stones 20 within region 26*a*. Once one of stones 20 has been knocked completely out of region 26*a*, the player throws the remaining of his four sticks 40 from midline 30 until all stones 20 have been knocked completely out of region 26*a*. After tossing the assigned four sticks, the other team has a turn. The designated player from the second team stands behind baseline 27*a* and throws their sticks at stones 20 within region 24*a*. Once one of stones 20 is knocked completely out of region 24*a*, the remaining sticks are thrown from behind midline 30 until all of stones 20 have been knocked completely out of region 24*a*. As soon as all of stones 20 have been knocked out of either region, the team corresponding to that region then arranges stones 20 in the configuration shown in FIG. 10. Play continues until one of the teams had knocked all of the stones from the configurations of FIGS. 5 and 10 out of the region.

Each player throws four tossing devices or sticks 40 per turn, even if a new stone arrangement is required during the player's turn. All sticks thrown from the baseline must pass the midline on the fly or the throw doesn't count. When a new configuration is placed within the region, the player returns to the baseline until the first stone is knocked completely out of the region. Thereafter, the player throws from the midline.

A stone that is knocked partially out of the region but is still touching the boundary of the region is considered still within the region. Alternate rules may be utilized, for example, if any part of the stone is outside of the region then it is considered out. Stones that are knocked out of the region and sticks that were thrown must be removed before the next turn. The player who is second to throw at the start of the game is allowed the last turn, even if the opposing player has knocked all of stones 20 from the final arrangement out of the region. In case of a draw where both players finish the final pattern in subsequent turns, one or more further stone arrangements are selected for the playoff round. During the playoff round, each player throws a fewer number of sticks per turn, for example, one stick per turn. As in regular play, the second player to start is entitled to a final throw, even if the opposing player has knocked all of the stones out of the region.

Each team may consist of two players with the players alternating throwing for their team. In other words, the first player throws four sticks, and then during that team's subsequent turn, his teammate throws for the team. In an advanced version of the game, all of the throws at the final stone arrangement are from the baseline. All sticks 40 are thrown by holding onto one end of the stick and "flinging" the stick". An optional rule provides that if one team advances by 15 stones or three arrangements, they automatically win. When playing on court 22*b*, the team throwing at region 24*b* may accidentally knock some stones out of the other region 26*b*. These accidental knock-outs count for the opposing team.

As can be appreciated, the layout of the playing court can be quite varied, as long as there is a delineated region in which to place stones 20 and one or more designated places from which to throw the sticks. In addition, any number of stones or other items can be selected for placement in a variety of other configurations, not necessarily limited to those shown in FIGS. 1–15. Finally, sticks 40 or any other objects may be used to knock the stones out of the delineated regions. The rules regarding throws from the baseline, midline, and rules regarding turns, number of throws, etc., may all be varied to provide many different challenging levels of play.

While only several embodiments of the present invention has been shown and described, it is to be understood that many changes and modifications may be made thereunto without departing from the spirit and scope of the invention as defined in the appended claims.

What is claimed is:

1. A game apparatus for play by two opposing teams, comprising:

a playing surface including two target receiving regions located in spaced distance relation, each region being assigned to a corresponding one of said teams;

two sets of target members, each set of target members being assigned to a corresponding one of said two target receiving regions;

a plurality of different target member configurations, each configuration constituting a round of the game, the teams choosing a selected number of configurations to determine the length of the game;

each set of target members being arranged in each of said plurality of different target member configurations within its respective target receiving region; and a set of tossing devices, wherein the teams alternate throwing said tossing devices by flinging said tossing devices at the opposite team's target members to knock all of said target members for all of said plurality of configurations completely out of their respective target receiving region in advance of the opposing team.

2. The game apparatus as claimed in claim 1, wherein said playing surface additionally includes:

a baseline situated on equal spaced distance away from said two target receiving regions, wherein at least one of said tossing devices are thrown at said regions from behind said baseline.

3. The game apparatus as claimed in claim 2, wherein said playing surface further includes:

a midline situated between said base and said two target receiving regions, wherein at least one of said tossing devices are thrown at said regions from behind said midline.

4. The game apparatus as claimed in claim 1, wherein said playing surface additionally includes:

two baselines, each situated an equal spaced distance away from a corresponding one of said target receiving regions, wherein at least one of said tossing devices are thrown at said regions from behind the baseline corresponding to that region.

5. The game apparatus as claimed in claim 4, wherein said playing surface further includes:

a midline situated between said baselines and said regions, wherein at least one of said tossing devices are thrown at said regions from behind said midline.

6. The game apparatus as claimed in claim 5, wherein said midline is situated equidistantly between said baselines and said regions, wherein said tossing devices are thrown from behind said baseline until a target member is knocked out of its region and thereafter said tossing devices are thrown from behind said midline until the entire set of target members is knocked out of its region.

7. The game apparatus as claimed in claim 6, wherein each baseline is aligned with the non-corresponding region and wherein each set of target members is sequentially arranged in one of a plurality of configurations.

8. The method of playing a game with two opposing teams, comprising the steps of:

delineating two spaced apart target receiving regions on a playing surface;

arranging a set of target members in a predetermined configuration within each target receiving region;

assigning one target receiving region and the respective set of target members to each team;

throwing a tossing device at the opposing team's target members repeatedly to knock the target members out of said target receiving region in advance of the opposing team;

rearranging the set of target members in a different predetermined configuration; and repeating said steps of throwing a tossing device and rearranging the set of target members until one team has knocked all of the target members for all of the predetermined configurations out of said region.

9. The method as claimed in claim 8, additionally comprising the step of:

creating a baseline on the playing surface and a midline between said baseline and said regions, following said step of delineating.

10. The method as claimed in claim 9, wherein said step of throwing includes:

throwing at least one tossing device from behind said baseline and throwing at least one tossing device from behind said midline.

11. A method of playing a game with two opposing teams, comprising the steps of:

delineating two spaced apart target receiving regions on a playing surface;

creating a baseline on the playing surface and a midline between said baseline and said regions;

arranging a set of target members in a predetermined configuration within each target receiving region;

assigning one target receiving region and the respective set of target members to each team;

throwing a tossing device at the opposing team's target members repeatedly to knock the target members out of said target receiving region in advance of the opposing team, including throwing at least one tossing device from behind said baseline and throwing at least one tossing device from behind said midline;

rearranging the set of target members in a further predetermined configuration; and repeating said steps of throwing a tossing device and rearranging the set of target members until one team has knocked all of the target members for all of the predetermined configurations out of said region.

* * * * *